US012134953B2

(12) United States Patent
Drenth et al.

(10) Patent No.: US 12,134,953 B2
(45) Date of Patent: Nov. 5, 2024

(54) CORE BARREL HEAD ASSEMBLY

(71) Applicant: VERACIO LTD, Salt Lake City, UT (US)

(72) Inventors: Christopher L. Drenth, Burlington (CA); Anthony Lachance, Burlington (CA); Vincent Primevert, Toronto (CA)

(73) Assignee: Veracio Ltd., Salt Lake City, UT (US)

( * ) Notice: Subject to any disclaimer, the term of this patent is extended or adjusted under 35 U.S.C. 154(b) by 0 days.

(21) Appl. No.: 17/768,617

(22) PCT Filed: Oct. 16, 2020

(86) PCT No.: PCT/US2020/055913
§ 371 (c)(1),
(2) Date: Apr. 13, 2022

(87) PCT Pub. No.: WO2021/076844
PCT Pub. Date: Apr. 22, 2021

(65) Prior Publication Data

US 2024/0102356 A1 Mar. 28, 2024

Related U.S. Application Data

(60) Provisional application No. 62/916,585, filed on Oct. 17, 2019.

(51) Int. Cl.

| | |
|---|---|
| ***E21B 25/10*** | (2006.01) |
| ***E21B 34/12*** | (2006.01) |
| ***E21B 47/01*** | (2012.01) |

(52) U.S. Cl.
CPC ..... *E21B 34/12* (2013.01); *E21B 25/10* (2013.01); *E21B 47/01* (2013.01)

(58) Field of Classification Search
CPC ..... E21B 34/12; E21B 25/10; E21B 47/01
(Continued)

(56) References Cited

U.S. PATENT DOCUMENTS 2,532,716 A 12/1950 Havlick
3,871,487 A * 3/1975 Cooper ..... E21B 10/64 175/236

(Continued)

OTHER PUBLICATIONS

International Search Authority Search Report and Written Opinion for PCT/US 20/55913, dated Feb. 26, 2021.

*Primary Examiner* — Taras P Bemko
(74) *Attorney, Agent, or Firm* — Ballard Spahr LLP

(57) ABSTRACT

A core barrel head assembly having a longitudinal axis can comprise an elongate tube body having an outer surface, an interior cavity, a proximal end, and a distal end. The elongate tube body can define a helical groove that extends from the interior cavity to the outer surface of the elongate tube body. The helical groove can be configured to allow the elongate tube body to elastically extend and compress. The elongate tube body can define at least one aperture that extends between the interior cavity and the outer surface. The core barrel head assembly can further comprise a valve body that is attached to the elongate tube body and is movable with respect to the proximal end of the elongate tube along the longitudinal axis, as the elongate tube body compresses. When sufficiently compressed, the valve body restricts flow through the at least one aperture.

19 Claims, 13 Drawing Sheets

(58) Field of Classification Search
USPC ..... 175/40
See application file for complete search history.

(56) References Cited

U.S. PATENT DOCUMENTS

| | | | | |
|---|---|---|---|---|
| 2002/0033281 | A1 | 3/2002 | Aumann et al. | |
| 2006/0169496 | A1 | 8/2006 | Puymbroeck et al. | |
| 2013/0105227 | A1* | 5/2013 | Drenth | E21B 25/02 175/246 |
| 2014/0174828 | A1* | 6/2014 | Muntz | E21B 25/02 175/246 |
| 2015/0300162 | A1* | 10/2015 | Drenth | E21B 25/16 175/44 |
| 2017/0306712 | A1 | 10/2017 | Uhlenberg | |
| 2018/0195359 | A1* | 7/2018 | Pray | E21B 23/01 |
| 2019/0284894 | A1* | 9/2019 | Schmidt | E21B 23/01 |
| 2022/0213751 | A1* | 7/2022 | Xie | E21B 10/26 |

* cited by examiner

CORE BARREL HEAD ASSEMBLY

CROSS-REFERENCE TO RELATED APPLICATIONS

This application is a national phase filing under 35 U.S.C. § 371 of International Application No. PCT/US2020/055913, filed Oct. 16, 2020, which claims priority to and the benefit of U.S. Provisional Application No. 62/916,585, filed Oct. 17, 2019, the entireties of each of which are hereby incorporated herein by reference.

FIELD

This disclosure relates generally to drilling apparatuses and, more specifically, to systems, devices, and methods for collecting core samples.

BACKGROUND

Core barrel head assemblies can have intricate passageways and mechanical components for operation and manipulation in a downhole environment. Such core barrel head assemblies have limited space for integrating additional components.

SUMMARY

Described herein is a core barrel head assembly having a longitudinal axis. The core barrel head assembly can comprise an elongate tube body having an outer surface, an interior cavity, a proximal end, and a distal end. The elongate tube body can define a helical groove that extends from the interior cavity to the outer surface of the elongate tube body. The helical groove can be configured to allow the elongate tube body to elastically extend from a neutral length to an elongated length.

The elongate tube body can define at least one aperture that extends between the interior cavity and the outer surface. The helical groove can be configured to allow the elongate tube body to elastically compress from the neutral length. The core barrel head assembly can further comprise a valve body that is attached to the elongate tube body and is movable with respect to the proximal end of the elongate tube along the longitudinal axis, as the elongate tube body compresses, from a first position to a second position. When in the second position, the valve body causes a greater restriction to flow through the at least one aperture than when the valve body is in the first position.

The core barrel head assembly can further comprise an electronics compartment having an outer surface. The valve body can define an interior cavity. The electronics compartment can be disposed within the interior cavity of the valve body. The electronics compartment can be attached to the valve body so that the interior surface of the interior cavity of the valve body and the outer surface of the electronics department define a fluid passage. At least one of the valve body, the electronics compartment, or a combination of at least one interior surface of the valve body and at least one exterior surface of the electronics compartment can define at least one opening for providing fluid communication between the fluid passage and the distal end of the valve body.

A system can comprise a drill string comprising a drill bit at a distal end, a core barrel head assembly, wherein the core barrel head assembly has a distal end, and a core tube assembly attached to the core barrel head assembly. The core tube assembly can comprise a core barrel having a distal end and a core lifter case at the distal end of the core barrel. When the drill bit is in a drilling configuration, the drill bit is spaced distally of the core lifter case. When the drill bit is in a core break configuration, the drill bit can be in contact with the core lifter case, and the elongate tube can be elongated from the neutral length.

A method can comprise retracting the drill string until the drill bit is in the core break configuration.

A core barrel head assembly can have a longitudinal axis. The core barrel head assembly can comprise an elongate tube body having an outer surface, an interior cavity, a proximal end, and a distal end. The elongate tube body can define at least one aperture that extends between the interior cavity and the outer surface and a valve body that is movable with respect to the proximal end of the elongate tube along the longitudinal axis from a first position to a second position. When in the second position, the valve body can cause a greater restriction to flow through the at least one aperture than when the valve body is in the first position.

The at least one aperture can define a total flow area of about 0.3 square inches.

The at least one aperture can have a width dimension along the longitudinal axis that is about 0.22 inches.

The elongate tube body can define a helical groove that extends from the interior cavity to the outer surface of the elongate tube body, wherein the helical groove is configured to allow the elongate tube body to elastically compress from a neutral length.

The valve body can be attached to the distal end of the elongate tube body.

The core barrel head assembly can comprise an electronics compartment having an outer surface. The electronics compartment can be disposed within the interior cavity of the valve body. The electronics compartment can be attached to the valve body so that the interior surface of the interior cavity of the valve body and the outer surface of the electronics department define a fluid passage. At least one of the valve body, the electronics compartment, or a combination of at least one interior surface of the valve body and at least one exterior surface of the electronics compartment can define at least one opening for providing fluid communication between the fluid passage and the distal end of the valve body.

A method can comprise advancing a drill string having a distal end. The drill string can comprise at least one drill rod defining an interior bore, a drill bit at the distal end of the drill string, and a core barrel head assembly. The core barrel head assembly can have a distal end and can be disposed within the interior bore of the at least one drill rod. A core barrel tube can be attached to the distal end of the core barrel head assembly. A core sample can be received in the core barrel tube until the elongate tube body compresses to a length in which the valve body is in the second position.

The method can further comprise retracting the drill string until the elongate tube body expands to a third length that is greater than the neutral length.

A core barrel head assembly can comprise a valve body having a distal end and a proximal end, wherein the valve body defines an interior cavity having an interior surface. An electronics compartment can have an outer surface. The electronics compartment can be disposed within the interior cavity of the valve body. The electronics compartment can be attached to the valve body so that the interior surface of the interior cavity of the valve body and the outer surface of the electronics department define a fluid passage. At least one of the valve body, the electronics compartment, or a combination of at least one interior surface of the valve body and at least one exterior surface of the electronics compartment can define at least one opening for providing fluid communication between the annular cavity and the distal end of the valve body.

The electronics compartment can house at least one of a battery or an electronic orientation instrument.

The fluid passage can be defined by the interior surface of the interior cavity of the valve body and the outer surface of the electronics department is an annular cavity.

The electronics compartment can define the at least one opening for providing fluid communication between the fluid passage and the distal end of the valve body.

A portion of the outer surface of the electronics compartment can define at least one male thread along a threaded length. The inner surface of the valve body can define at least one corresponding female thread. The electronics compartment can threadedly couple to the valve body via the at least one male thread and the corresponding at least one female thread. The at least one opening can extend through the electronics compartment along the threaded length.

The at least one opening can comprise a plurality of openings separated by respective radially extending webs.

The valve body can define the at least one opening for providing fluid communication between the fluid passage and the distal end of the valve body.

The combination of at least one interior surface of the valve body and at least one exterior surface of the electronics compartment can define the at least one opening for providing fluid communication between the fluid passage and the distal end of the valve body.

The core barrel head assembly can comprise a single thrust bearing.

In some embodiments, the core barrel head assembly does not comprise a grease port.

BRIEF DESCRIPTION OF THE DRAWINGS

These and other aspects of the invention will become more apparent in the detailed description in which reference is made to the appended drawings wherein.

DETAILED DESCRIPTION

Figure 1:
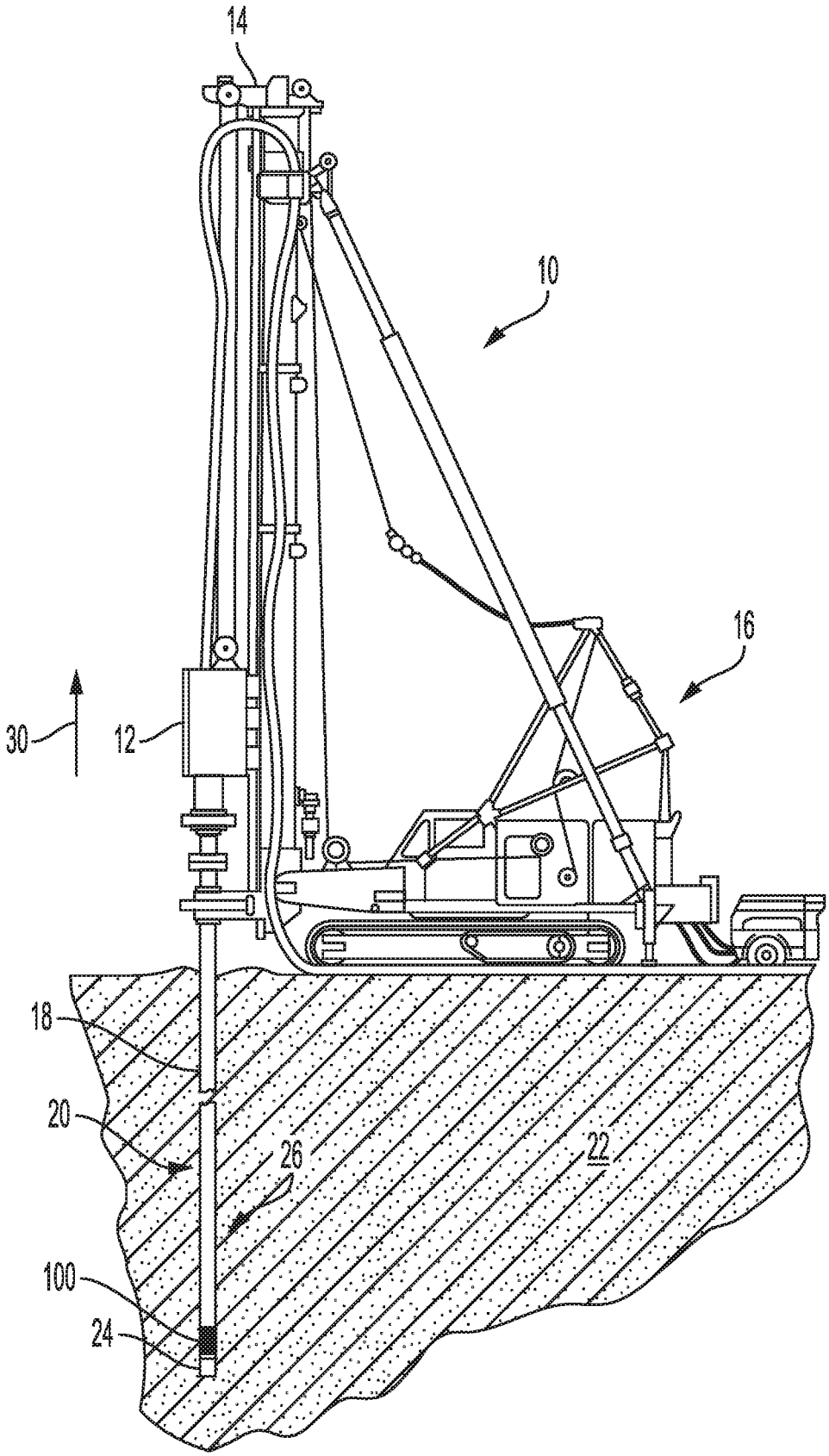
FIG. 1 is a side view of a drilling assembly in accordance with embodiments disclosed herein.

The present invention can be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an," and "the" include plural referents unless the context clearly dictates otherwise. Thus, for example, reference to "an aperture" can include two or more such apertures unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. Optionally, in some aspects, when values are approximated by use of the antecedent "about," "approximately," or "substantially," it is contemplated that values within up to 15%, up to 10%, up to 5%, or up to 1% (above or below) of the particularly stated value or characteristic can be included within the scope of those aspects.

As used herein, the term "proximal" refers to a direction toward a drill rig or drill operator (and away from a formation or borehole), while the term "distal" refers to a direction away from the drill rig or drill operator (and into a formation or borehole).

As used herein, the terms "optional" or "optionally" mean that the subsequently described event or circumstance may or may not occur, and that the description includes instances where said event or circumstance occurs and instances where it does not.

The word "or" as used herein means any one member of a particular list and also includes any combination of members of that list unless otherwise clear from the context.

Figure 2:
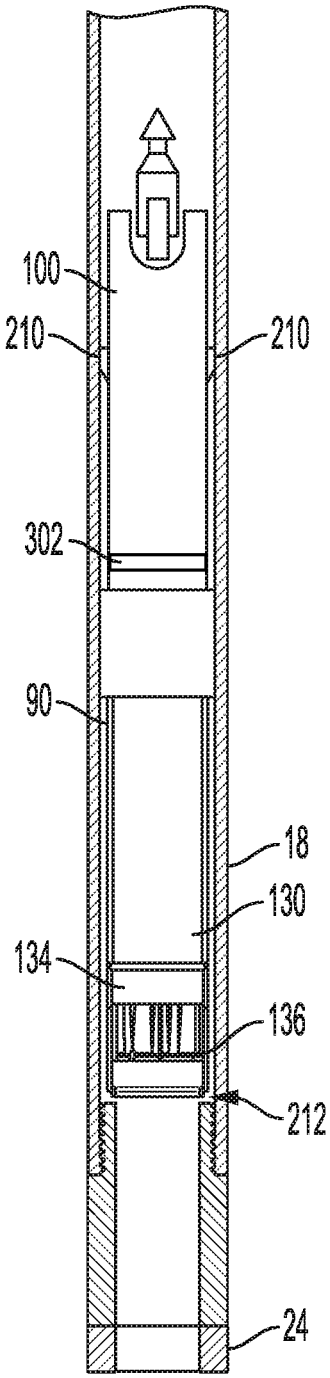
FIG. 2 is a cross sectional view of an inner tube assembly of the drilling assembly as in FIG. 1.
Figure 3:
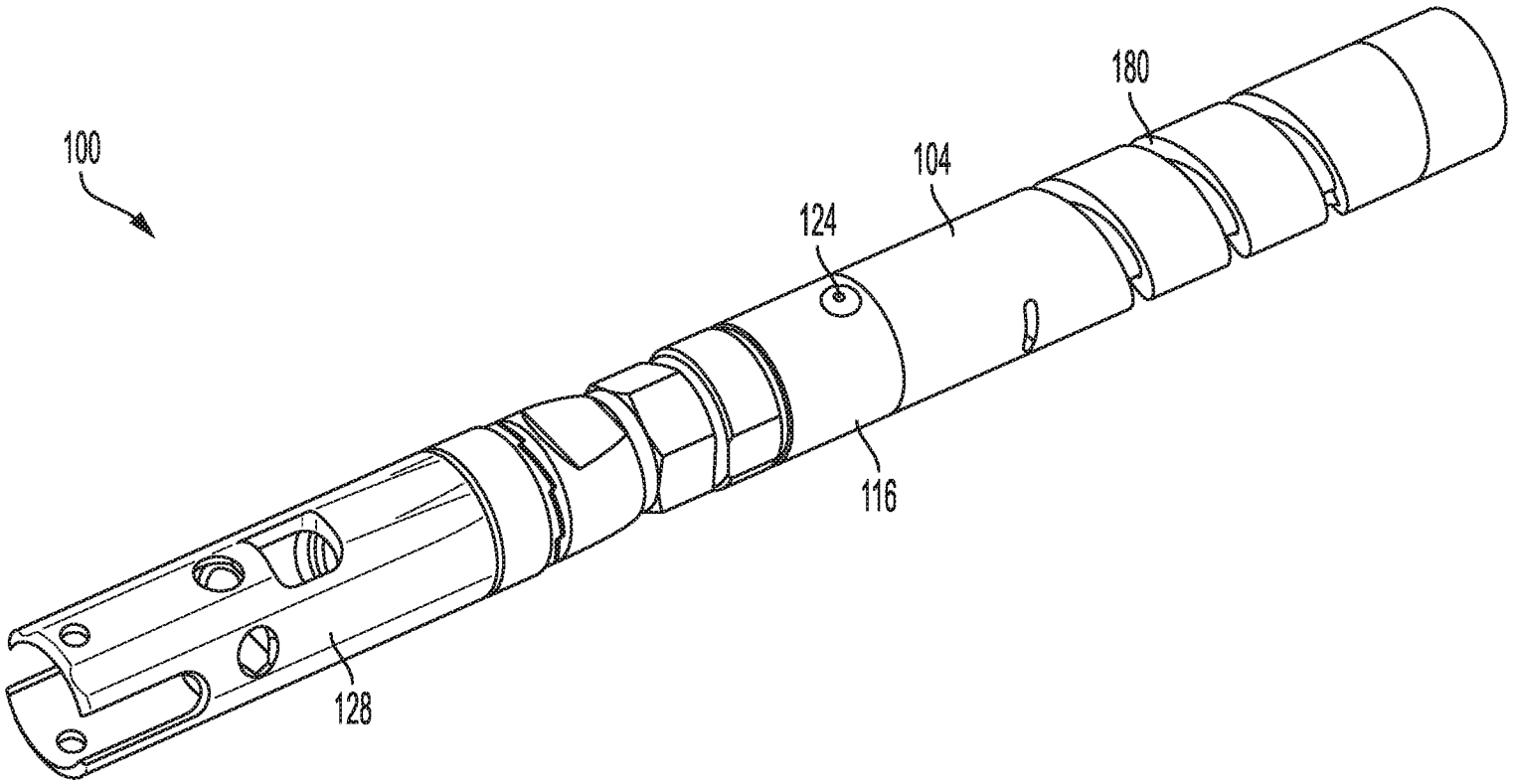
FIG. 3 is a perspective view of a core barrel head assembly in accordance with embodiments disclosed herein.
Figure 4:
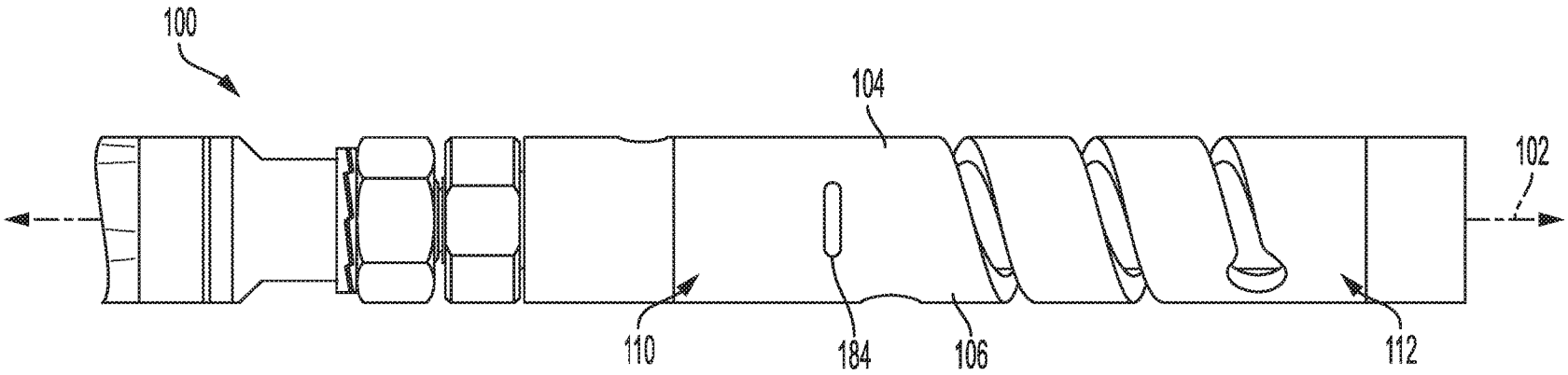
FIG. 4 is a side view of the core barrel head assembly of FIG. 3.
Figure 5:
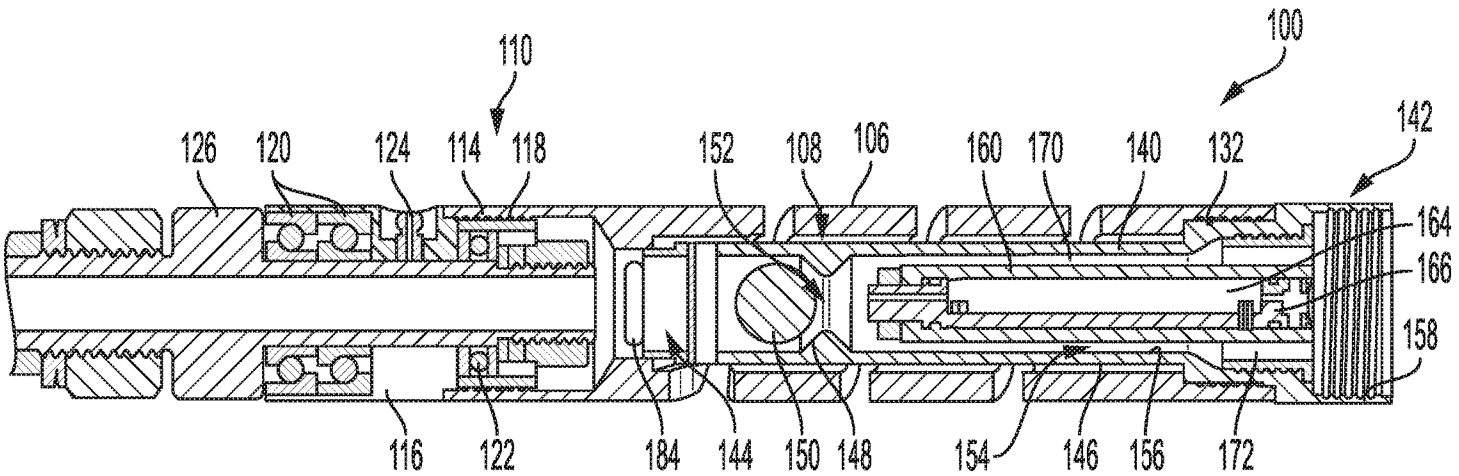
FIG. 5 is a cross-sectional view of the core barrel head assembly of FIG. 3.
Figure 6:
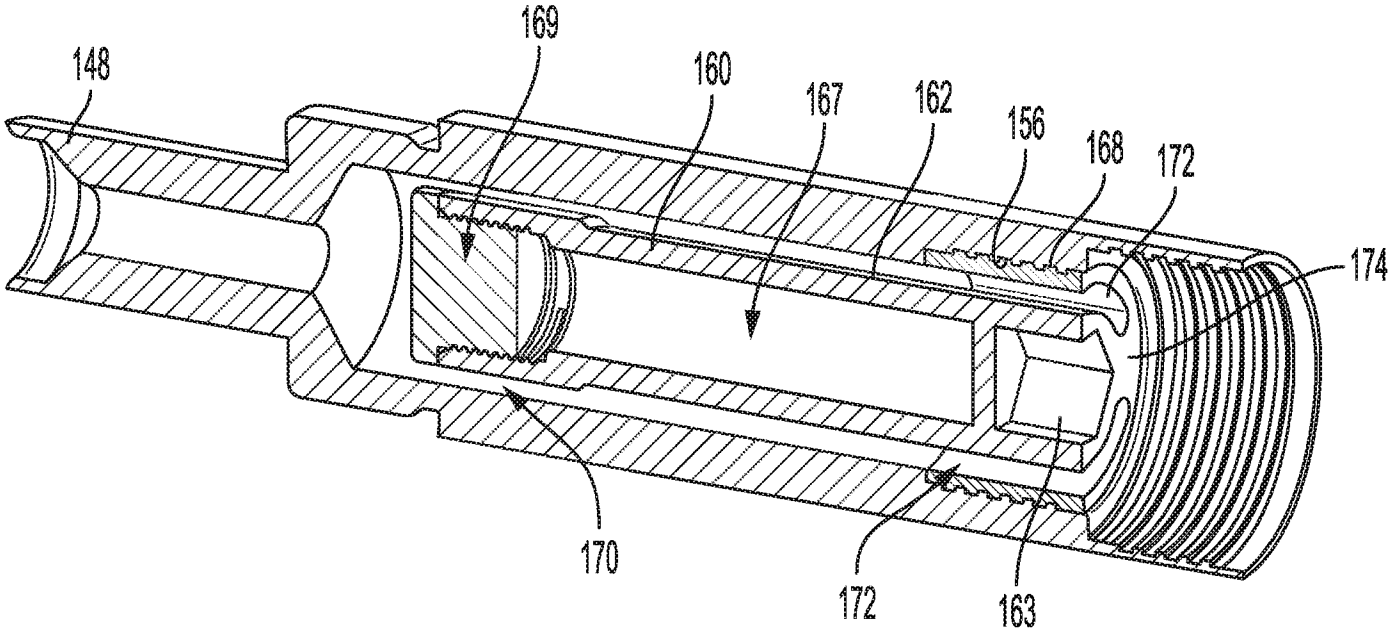
FIG. 6 is a perspective sectional view of a valve body and electronics compartment of the core barrel head assembly as in FIG. 3.

Disclosed herein, with reference to FIGS. 1 and 2, is a core barrel head assembly 100 for use with a drilling system 10 that includes a drill head 12. The drill head 12 can be coupled to a mast 14 that, in turn, is coupled to a drill rig 16. The drill head 12 can be configured to have one or more tubular threaded members 18 coupled thereto. Tubular members 18 can include, without limitation, drill rods, casings, and down-the-hole hammers. For ease of reference, the tubular members 18 will be described herein as drill string components. The drill string component 18 can in turn be coupled to additional drill string components 18 to form a drill or tool string 20. In turn, the drill string 20 can be coupled at a distal end to a drilling tool 24, such as a rotary drill bit, a core sampling drill bit (e.g., an impregnated core sampling drill bit), or a percussive bit, configured to interface with the material, or formation 22, to be drilled. The drilling tool 24 can form a borehole 26 in the formation 22. The drilling tool 24 can further form a core sample that can be received within an inner tube assembly 90, comprising a core tube 130 and a core barrel head assembly 100, as further described herein. In various aspects, and as further disclosed herein, the core barrel head assembly 100 can comprise an indicator 302 that can be configured to detect a force applied to the core barrel assembly. The indicator can be used to determine whether the core barrel is full or whether the core is stuck within the core tube 130.

Referring to FIGS. 3-12, described herein is a core barrel head assembly 100 having a longitudinal axis 102. The core barrel head assembly 100 can comprise an elongate tube body 104 having an outer surface 106, an interior cavity 108, a proximal end 110, and a distal end 112. The proximal end 110 can define threads 114 (optionally, female threads) that couple to complementary threads 118 of a bearing housing 116. The bearing housing 116 can house a thrust bearing 120, or a plurality of thrust bearings 120 (e.g., two, three, or more thrust bearings 120). Optionally, the bearing housing 116 can further house a lower thrust bearing 122 configured to receive load during hoisting (or, optionally, a plurality of such bearings). In some aspects, the bearing housing 116 can comprise a grease port 124 for providing grease to the thrust bearings 120 and/or the lower thrust bearing 122. Optionally, in further aspects, the thrust bearings 120 and lower thrust bearing 122 can each optionally be greaseless. For example, the bearings 120 can be solid oil bearings. In this way, the grease port can be omitted, allowing for a longitudinally smaller configuration of the bearing housing 116, thereby allowing additional space for including other features (e.g., electronics or apertures 184). The thrust bearings 120 and lower thrust bearing 122 can rotationally engage a spindle 126. The spindle can allow an upper portion of the core barrel head assembly 100, including a latch body 128, to rotate with the drill string as the core tube 130 (FIG. 2) at a distal end of the core barrel head assembly 100 remains rotationally stationary to engage a core sample.

The distal end 112 of the elongate tube body 104 can define threads 132 for threadedly coupling to valve body 140. The valve body 140 can have a distal end 142, a proximal end 144, and an outer surface 146. The valve body 140 can define a valve seat 148 for engagement with a valve ball 150 to provide a check valve 152. The valve body 140 can define an interior cavity 154 having an interior surface 156. The interior cavity 154 can optionally be cylindrical. The valve body 140 can define female threads 158 at the distal end 142 for threadedly coupling to the core tube 130 (FIG. 2).

An electronics compartment 160 having an outer surface 162 can be disposed at least partially within the interior cavity 154 of the valve body. The distal end 142 of the valve body 140 can define female threads 156 that can threadedly couple to male threads 168 on the outer surface 162 of the electronics compartment 160. The electronics compartment can define a hexagonal socket 163 that receives a hexagonal tool (e.g., an Allen key) for attaching to and removing the electronics compartment from the valve body. The electronics compartment 160 can define an interior volume 167 for housing a battery 164, an electronic orientation instrument 166, or both. The electronic orientation instrument 166 can comprise various sensors (e.g., accelerometers, magnetometers, gyroscopes, etc.) that can provide orientation data of the electronic orientation instrument and, accordingly, a core sample in the core tube 130. Optionally, the internal volume 167 can be closed and sealed with a threaded cap 169. In addition to collecting sample orientation, sensors in the electronic orientation instrument 166 can collect information related to hole survey data, hole geophysical data, hole visual data, hole depth, tooling valve status, and further data as is known in the art.

The outer surface 162 of the electronics compartment 160 and the inner surface 156 of the interior cavity 154 can cooperate to define a fluid passage 170. The fluid passage 170 can optionally be annular. The fluid passage 170 can enable fluid to pass therethrough for various functions, including, for example, lubricating the drill bit during drilling.

Figure 7:
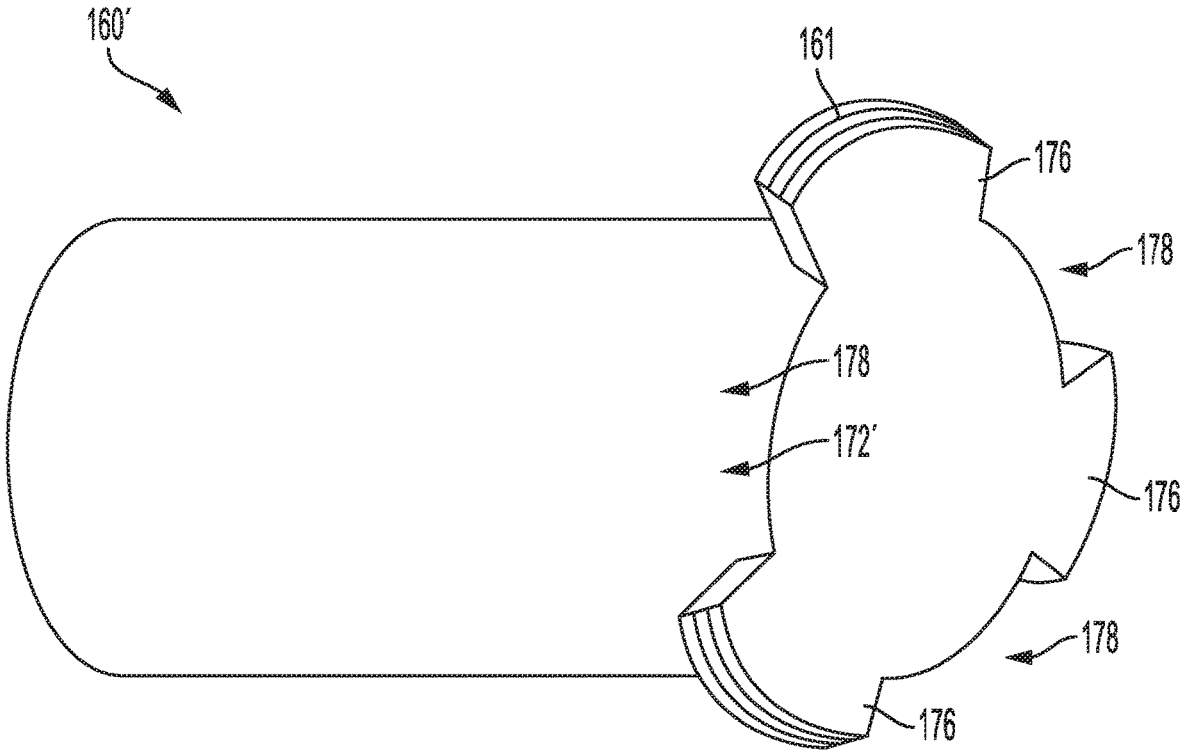
FIG. 7 is a perspective view of another electronics compartment for use with the core barrel head assembly as in FIG. 3.
Figure 8:
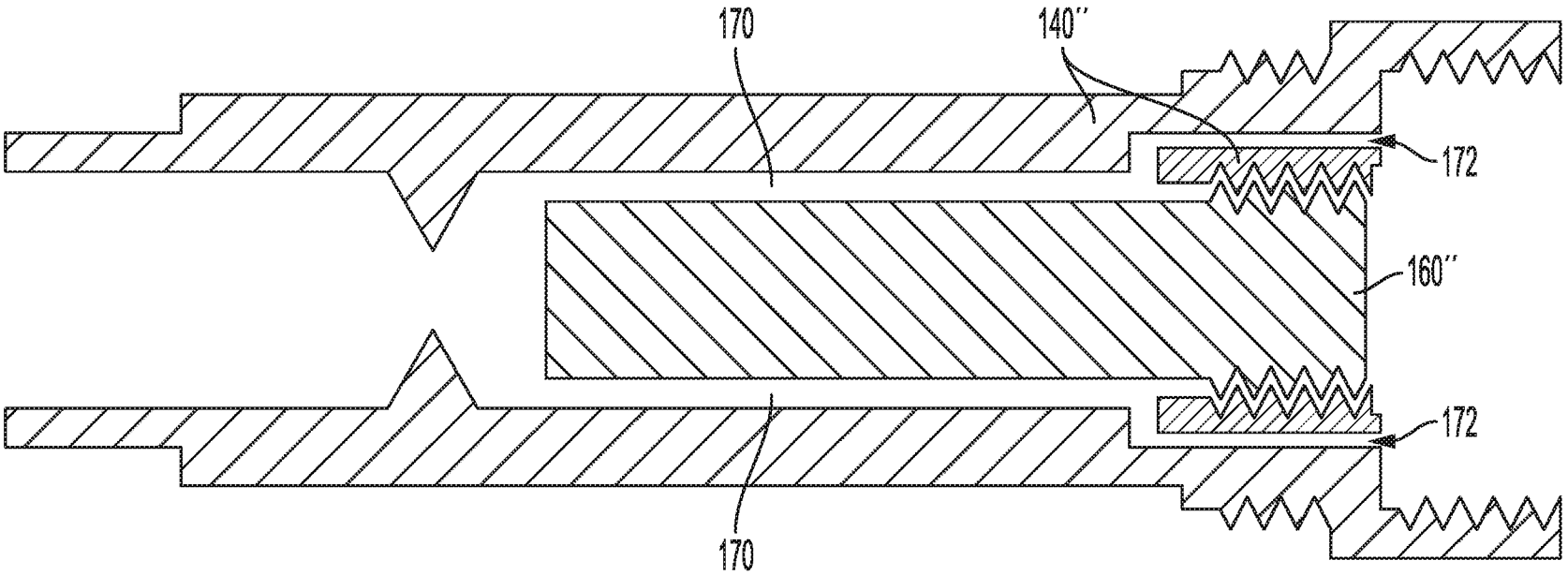
FIG. 8 is a perspective view of a valve body and yet another electronics compartment for use with the core barrel head assembly as in FIG. 3.
Figure 9:
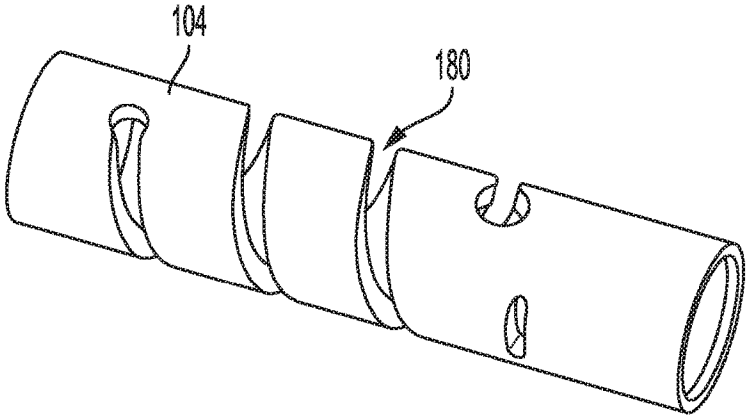
FIG. 9 is a perspective view of an elongate tube body of the core barrel head assembly of FIG. 3.

In some embodiments, the electronics compartment 160 can comprise at least one opening 172 that provides fluid communication between the distal end of the electronics compartment 160 and the fluid passage 170. For example, the electronics compartment 160 can comprise plurality of (e.g., two) annular section openings 172 separated by webs 174 that extend along the length of the threads 168. Referring to FIG. 7, in still further embodiments, a valve body 140' and an electronics compartment 160' can cooperate to define the one or more openings 172'. For example, the threaded portion of the electronics compartment can comprise a plurality (e.g., two or three) sections 176 having longitudinally extending gaps 178 therebetween. The threads 156 of the valve body 140 and the gaps 178 of the electronics compartment can cooperate to provide the openings 172'. Referring to FIG. 8, in further embodiments, a valve body 140" can define the one or more openings 172" that provide fluid communication between the distal end of the electronics compartment 160" and the fluid passage 170.

Including the electronics compartment 160 within the core barrel head assembly 100 can consume space (particularly, linear space) within the core barrel head assembly 100. In order to accommodate the electronics compartment 160, one or more of the following optional aspects can be implemented. In some embodiments, greaseless bearings can be used, thereby eliminating the grease fitting and allowing for a shorter bearing housing. In addition, or alternatively, a single thrust bearing (optionally, a greaseless bearing) can be substituted for the conventional plurality of thrust bearings 120. The single thrust bearing can have a greater load rating than the thrust bearings of configurations having a plurality of thrust bearings. The bearing can have a load rating that exceeds the thrust capacity of the drill bit. Accordingly, the bearing can have a load rating that varies depending on the core size. For an NQ size drill bit having an outer diameter of 75.7 mm and an inside diameter of 47.6 mm, for example, the thrust bearing can have a dynamic load of at least 8,500 lbf. According to some optional aspects, conventional shut-off valves that detect when the core tube is full or jammed can be eliminated, and, instead, drill load sensing can be used to determine when the core tube is full or jammed. Optionally, conventional core break springs and shut-off valve springs can be integrated into the body of the core barrel head assembly, as further disclosed herein. Thus, the elongate tube body 104 and valve body 140 can cooperate to serve as the indicator 302.

The elongate tube body 104 can define at least one helical groove 180 that extends around the circumference of the elongate tube body 104 and along the longitudinal axis 102. As used herein, "helical" should be understood to mean a path that wraps around the circumference and extends along the length of the elongate tube. Accordingly, the helical groove 180 as disclosed herein, should be understood to include, for example, a groove having a continuous profile and a constant pitch (as shown), a groove having a varying pitch, and a stair step groove that alternatingly extends in a purely longitudinal direction for a segment and in a purely circumferential direction for another segment. In some embodiments, the helical groove 180 can comprise a spiral shape having a constant pitch. Optionally, the helical groove 180 can comprise about three revolutions around the circumference of the elongate tube body 104. According to at least one optional embodiment, the helical groove 180 can be about 0.35 inches wide and can have circular stress relief features at each end. The circular stress relief feature at the distal end of the helical groove 180 can be about 0.75 inches in diameter, and the stress relief feature at the proximal end of the helical groove 180 can be about 0.5 inches in diameter. The pitch of the groove can optionally be about 1.7 rotations per inch. It should be understood that the disclosed dimensions are optional and that the dimensions can be selected to provide operative aspects as further disclosed herein.

Figure 10:
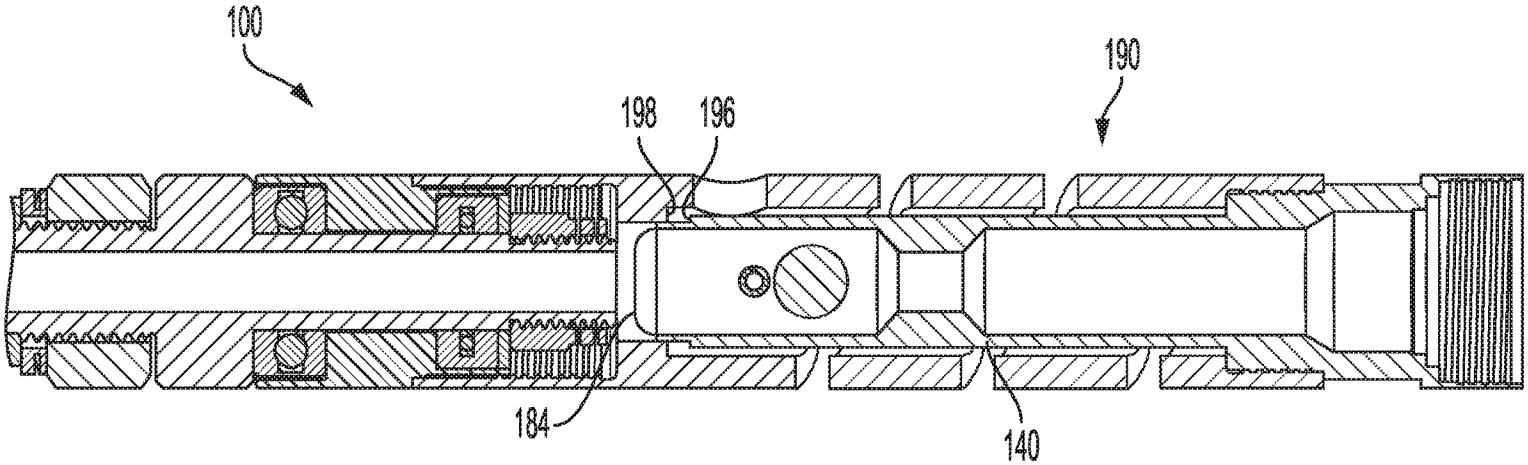
FIG. 10 is a cross-sectional view of the core barrel head assembly of FIG. 3 when in a neutral configuration.

The helical groove 180 can enable the elongate tube body 104 to compress from a neutral length 190 (i.e., the length of the elongate tube when neither in compression nor tension, as shown in FIG. 10). The elongate tube body 104 can define one or more apertures 184 that extend between the outer surface 106 and the interior cavity 108. Optionally, the elongate tube body 104 can define two slot-shaped apertures that are spaced 180 degrees about the circumference of the elongate tube body. The aperture(s) 184 can be elongated about the circumference of the elongate tube body. The aperture(s) 184 can be disposed along the length of the elongate tube body 104 so that when the elongate tube body 104 is in the neutral length, each of the apertures 184 is at least partially open, and when the elongate tube body 104 is compressed from the neutral length 190, the proximal end 144 of the valve body 140 blocks or substantially blocks the aperture(s) 184. In this way, as the drill string is advanced within a borehole, if the core tube jams or core tube is full, the elongate tube body 104 can compress. As the elongate tube body 104 compresses, the valve body 140 can move proximally with respect to the proximal end of the elongate tube body 140 to block each aperture 184. In some embodiments, the valve body 140 can entirely block each aperture 184. In further embodiments, the valve body 140 can partially reduce the effective area of each aperture 184. That is, in partially blocking each aperture 184, the valve body can reduce a minimum cross sectional area through which fluid can flow from the interior cavity to the outer surface. In some situations, it can be beneficial to only partially block each aperture 184 to allow some flow therethrough, which can provide circulation to the drill bit.

Thus, the valve body 140 can cause a greater flow restriction through the aperture(s) 184 as the valve body moves proximally with respect to the proximal end of the elongate tube body 104. In at least some drilling systems, a pressure relief valve can regulate a maximum pressure. According to some aspects, when the valve body 140 blocks the aperture(s) 184, the pressure can rise beyond the set pressure of the pressure relief valve to thereby cause the valve to open and, thereby, indicate that the core tube is full. It is contemplated that the change in flow restriction can be reflected as a change in the percentage of the two-dimensional area of the aperture 184 that is blocked by the valve body 140. Optionally, the change in the percentage of the area of the aperture that is blocked by the valve body can be at least 20%, at least 40%, at least 60%, at least 80%, at least 90%, at least 95%, at least 99%, or, optionally, be about 100%. It is understood that the percentage change in blocked area should be sufficient to distinguish from minor variations in the relative positioning of the valve body that are not associated with proximal movement of the valve body for purposes of causing greater flow restriction.

Optionally, it is contemplated that the valve body 140 can be moveable about and between a fully "open" position in which about 50% of the aperture 184 is blocked and a fully "closed" position in which 100% of the aperture is blocked. Optionally, when the valve body is in the fully "open" position, the area of the aperture that is blocked by the valve body can range from about 0.1 square inches to about 0.25 square inches. When the valve body is in the fully "closed" position, the area of the aperture that is blocked by the valve body can range from about 0.25 square inches to about 0.5 square inches. Optionally, it is contemplated that the change in flow restriction can correspond to a change in "blocked area" of the aperture of at least 0.01 square inches, at least 0.05 square inches, at least 0.1 square inches, or at least 0.2 square inches. It is understood that the change in blocked area should be sufficient to distinguish from minor variations in the relative positioning of the valve body that are not associated with proximal movement of the valve body for purposes of causing greater flow restriction.

Optionally, when the valve body causes a complete or substantially complete flow restriction, the greater flow restriction can correspond to a maximum pressure setting (as measured by the operator, such as with a pump). However, if the valve body 140 causes only a partial flow restriction, then the greater flow restriction can correspond to a pressure less than the maximum pressure setting. The changing flow restriction can cause the fluid pressure to change, and a drill operator can detect the change in fluid pressure. Optionally, the change in fluid pressure can be at least 20%, at least 25%, at least 30%, at least 35%, at least 40%, at least 45%, or at least 50%. The change in fluid pressure can indicate to the drill operator that the core sample is jammed or that the core tube is full. In some embodiments, an alarm can activate when the fluid pressure passes a threshold to notify the operator that the core tube is full or jammed. Optionally, the alarm can be triggered manually by the drill operator. Alternatively, the alarm can be triggered automatically in response to a change detected by a pressure sensor associated with the drill string (optionally, a sensor housed within the electronics compartment 160), with the detected change in pressure being indicative of a full or jammed core tube.

It should be understood that in some situations during drilling, particularly through difficult ground conditions, the valve body 140 can block and unblock the aperture(s) 184 in rapid succession. Whether automatically or by operator interpretation, this rapid blocking and unblocking can be differentiated from when core tube is full, causing the valve body to block the aperture(s) for a continuous period of time.

Figure 11:
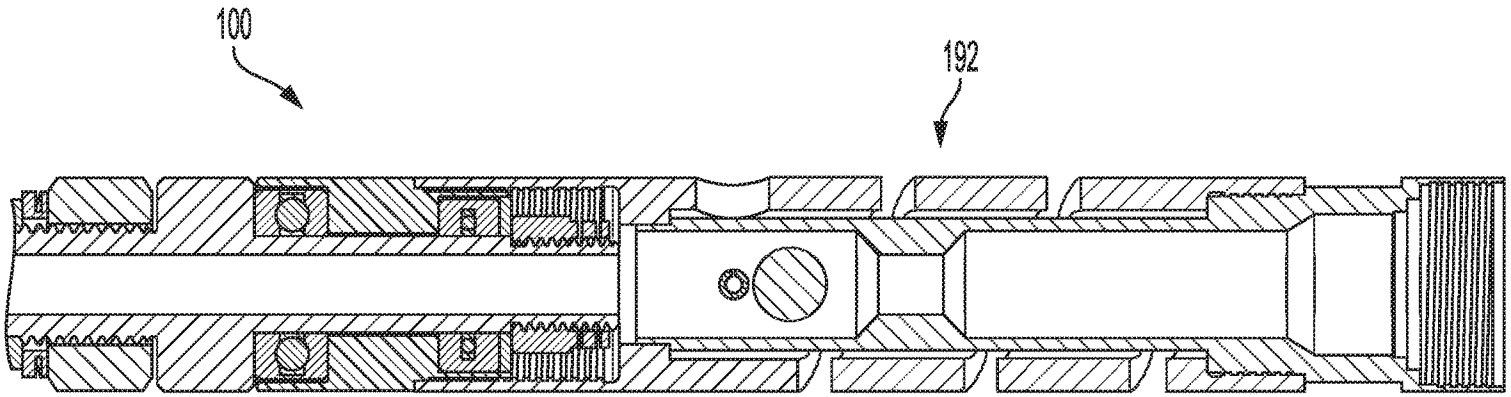
FIG. 11 is a cross-sectional view of the core barrel head assembly of FIG. 3 when in a compressed configuration.
Figure 12:
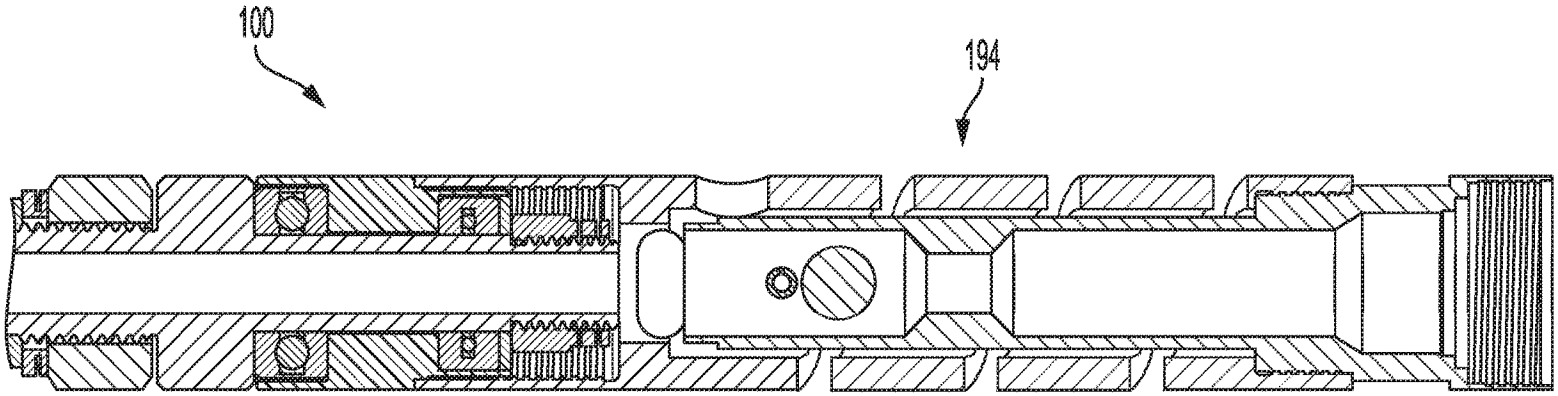
FIG. 12 is a cross-sectional view of the core barrel head assembly of FIG. 3 when in an elongated configuration.
Figure 13:
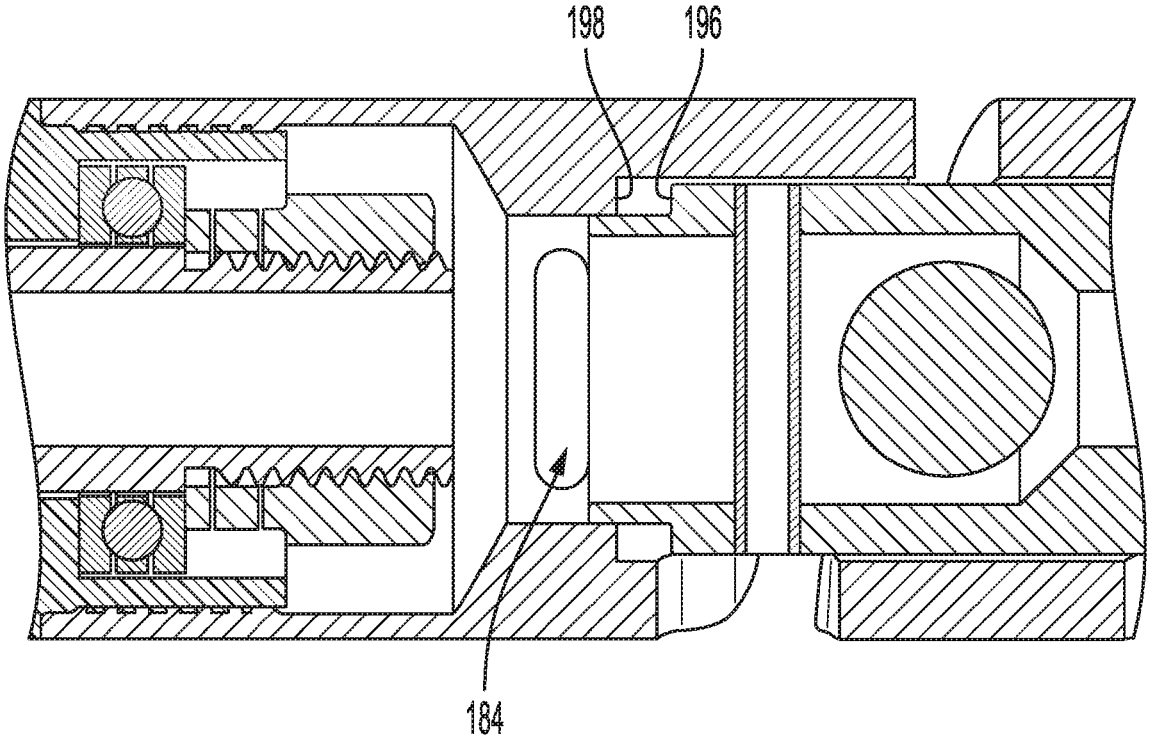
FIG. 13 is a partial cross-sectional view of a core barrel head assembly having another aperture profile.
Figure 14:
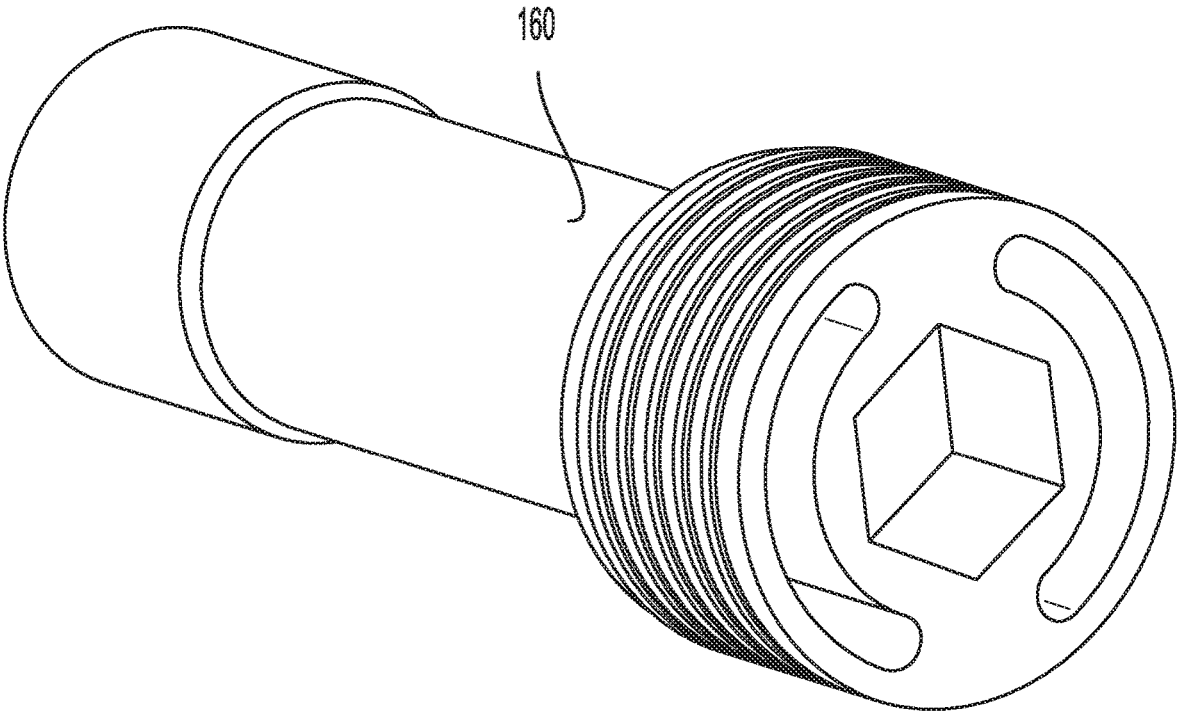
FIG. 14 is a perspective view of the electronics compartment as in FIG. 6.

Optionally, the proximal end 144 of the valve body 140 can have a turned down (downwardly facing) portion that defines a shoulder 196. The interior surface of the elongate tube body 104 can define a complementary shoulder 198 that can act as a stop that engages the shoulder 196 of the valve body 140. In this way, the elongate tube body 104 can be limited to a minimum compressed length 192 (FIG. 11).

The aperture(s) 184 can have a cross sectional area (in the case of a plurality of apertures, a combined cross sectional area) in a radial dimension that is perpendicular to the longitudinal dimension, wherein the cross sectional area is selected to be at least as large as the minimum cross sectional area in the head assembly so that flow through the aperture does not increase flow restriction during drilling. Moreover, the apertures provide transition porting from the head porting to the flow path 170, which provides a pressure drop, so an oversized aperture or oversized apertures can be beneficial in minimizing pressure drop along the core barrel head assembly 100. The size of the aperture(s) 184 in the longitudinal dimension 102 can be limited based on compressibility of the elongate tube body 104 or other such limits. That is, because the compressible displacement of the elongate tube body 104 and, thus, the travel of the valve body 140 is limited, the geometry and size of the aperture(s) can be limited in order to significantly restrict the flow through the aperture(s). Accordingly, in some embodiments, the size of the aperture(s) 184 in the longitudinal dimension 102 can be less than a quarter inch, or about 0.22 inches.

Referring to FIG. 2, the core barrel head assembly 100 can comprise a core lifter case 134 attached at a distal end of the core tube 130. A core lifter 136 can move within the core lifter case 134 to engage and grip the core sample during core break and core retrieval. A non-limiting example of a core lifter in accordance with embodiments disclosed herein is provided in U.S. Pat. No. 8,770,320 to Drenth et al., issued Jul. 8, 2014, the entirety of which is hereby incorporated by reference herein.

The core barrel head assembly 100 can be positioned at a distal end of the drill string 20 and engage the drill string via latches 210. During drilling operations, the drill bit can be spaced from the core lifter case to provide a bit gap 212 that allows fluid to pass therethrough and lubricate the drill bit. During core break, the drill string is lifted until the bit gap is closed so that the bit can pull on the distal end of the core lifter case. Conventional core barrel head assemblies comprise a compressible core break spring that compresses to keep the core tube in a fixed longitudinal position so that the core tube does not move with respect to the core sample. According to some aspects, the conventional core break spring can be eliminated, and the elongate tube body 104 can extend under tension from the neutral length 190 to an elongated length 194 (FIG. 11) at which point the drill bit engages the core lifter. In this way, the elongate tube body 104 can replace the conventional core break spring. That is, as the drill string is retracted in the proximal direction 30 (FIG. 1), the upper portion of the core barrel head assembly 100 rests on a landing ring of the drill string and, thus moves upward with the drill string. As the core tube 130 stays in a fixed position with respect to the core sample and, thus, the formation, the elongate tube body 104 can elongate to a length at which the system is in a core break configuration in which the bit gap is closed and the drill bit engages the core lifter case. The various elongate tube bodies can optionally have apertures at various positions along their respective lengths.

The material of the elongate tube body 104 can be selected to have an elastic modulus that provides significant and linear load response to small displacements. The material can optionally be traditional metals, or, in further embodiments, engineered amorphous metals, engineered composite metals, etc. In addition to the material, the outer diameter of the elongate tube body 104, wall thickness, and the groove dimensions and geometry can be selected to provide a body having a desired spring constant while allowing for purely elastic deformation. For example, according to some aspects, the spring constant can be about 11,110 lbf/in. for an NQ drill bit size. Optionally, the spring constant can be selected based on the material of the formation (and the recovered core sample). For example, granite can have a tensile strength of 2000 psi. Accordingly, the spring constant can be selected to allow compression and elongation for various materials. Optionally, the spring constant can range from about 10,000 lbf/in. to about 12,000 lbf/in. In still further embodiments, the at least one helical groove can comprise a plurality of grooves, such as, for example, dual grooves that are separated by 180 degrees about the circumference of the elongate tube body 104. A desirable spring constant can have a significant load resistance that allows the drill to push the sample tube through sticky/swelling clays or problematic ground conditions without compressing the elongate tube body 104 until the valve body 140 blocks or sufficiently blocks the aperture(s) 184, thereby falsely indicating that the core tube 130 is full. According to various embodiments, an operator can select from various elongate tube bodies 104 having various spring constants based on ground conditions.

In order to use a single spring for both core break and detection of a jammed or full core tube, it is beneficial to account for certain parameters. The elongate tube body 104 should be able to elastically extend the length of the bit gap. Moreover, the elongate tube body 104 must provide enough spring tension once extended to the elongated length 194 (when the drill bit engages the core lifter case) in order to allow the core lifter to seat in between the core sample and the core lifter case. The aperture 184 can be positioned along the length of the elongate tube body 104 so that, for the spring constant provided by the elongate tube body, a select force causes the valve body 140 to block the aperture 184. The spring force of the elongate tube body 104 when the elongate tube body is in the compressed configuration 194 can optionally match the spring constant of a compression spring used in conventional shut-off valves for detecting when the core sample is full. Further, the valve body can block the valve aperture at a load that is similar to that of a conventional shut-off valve. In some embodiments, conventional shut-off valves can close under a load of about 2500 lbf, although the load can vary depending on the size and configuration.

A core bit can be used to collect a core sample is a hollow cylinder with a cutting surface on one face of the hollow cylinder. The core bit can be fixedly attached on one end of a cylindrical drill rod and inserted into a previously drilled bore hole. New sections of drill rods can be added to the upper end of the original rod, creating a series of connected drill rods in what is termed a drill string, as the core bit is pushed into the borehole. Each section of drill rod can be on the order of 10 feet long. When the core bit reaches the bottom of the borehole, the core bit can be forced against a rock strata as the core bit is rotated by rotating the drill string. The combination of the force and the rotating cutting surface can cut a cylindrical core sample from the rock strata. Drilling fluid can be pumped into the borehole to cool and lubricate the drill bit. Optionally, the drilling fluid can pass down the drill string and through a bit gap, as disclosed herein, between the core lifter case and the drill bit. The core sample can be captured in an interior portion of the drill string, within the core tube, behind the core bit until the core sample can be retrieved from the borehole. The length of an interior tube containing a core barrel is typically five feet to 30 feet in length.

The drill string can be retracted, thereby engaging the core lifter to seat between the core sample and the core lifter case. In doing so, the bit gap can close so that the drill bit biases against the core lifter case. As the drill string is further retracted, the engagement between the core lifter applies tension to the core, thereby causing a core break, whereby the core sample separates from the formation. The inner tube assembly with the core sample inside can be retrieved via wireline to retrieve the core sample from the bore.

It is contemplated that, in some optional aspects, it can be desirable for the core barrel head assembly 100 to have different spring rates for core break (spring tension) and for valve shutoff (blocking the apertures 184 in spring compression). For example, valve shutoff can require substantially smaller forces than core break. Accordingly, in some aspects, the core barrel head assembly 100 can have a first spring rate in tension that is configured for spring break and a second spring rate in compression that is configured for allowing compression. Optionally, this can be accomplished via compound springs. For example, a second spring (not shown) can be configured to apply a spring force for only a portion of the travel between the proximal end 110 and the distal end 112 between the elongate length and the compressed length. Said second spring can optionally be a compression spring or a tension spring.

Optionally, in still further aspects, it is contemplated that the spring rate can be variable. For example, the helical groove 180 that defines the spring can have a variable pitch. In this way, movement between the proximal end 110 and distal end 112 of the elongate tube body 104 can be subject to a nonlinear spring force between the elongate length and the compressed length.

In still further aspects, it is contemplated that, instead of the valve body 140 moving axially to block the apertures 184, the core barrel head assembly 100 can comprise a conventional valve comprising a radially expandable valve ring to serve as the indicator 302. For example, in some embodiments, the lower core barrel may also comprise one or more compression washers that restrict the flow of drilling fluid once the core sample tube is full, or once a core sample is jammed in the core sample tube. The compression washers can be axially compressed when the drill string and the upper core barrel press in the drilling direction, but the core sample tube does not move axially because the sample tube is full or otherwise prevented from moving downwardly with the drill string. This axial compression causes the washers to increase in diameter so as to reduce, and eventually eliminate, any space between the interior surface of the drill string and the outer perimeter of the washers. As the washers reduce this space, they can cause an increase in drilling fluid pressure. This increase in drilling fluid pressure may function to notify an operator of the need to retrieve the core sample and/or the inner core barrel.

In yet further aspects, and with reference to FIG. 2, the indicator 302 of the core barrel head assembly 100 can optionally comprise or be a load cell that is configured to measure axial force on the core tube. Thus, the load cell can serve as the indicator 302. The load cell can be in communication with a computing device via conventional communication means for providing feedback to an operator. The measured axial force can indicate that the core sample is stuck/jammed within the core tube. In further aspects, the measured axial force can indicate that the core barrel is full.

In further aspects, the disclosed core barrel assemblies can comprise latch mechanisms and latch-seat features as are known in the art. In these aspects, it is contemplated that the latch mechanisms and latch-seat features can have significant tolerance and axial movement such that, during a core block or jamming event, the landing shoulder of the head assembly can lift off of the mating landing ring in the outer tube assembly and provide fluid bypass, thereby causing a fluid pressure drop that can serve as an indication of a core jamming in the core tube.

Figure 15:
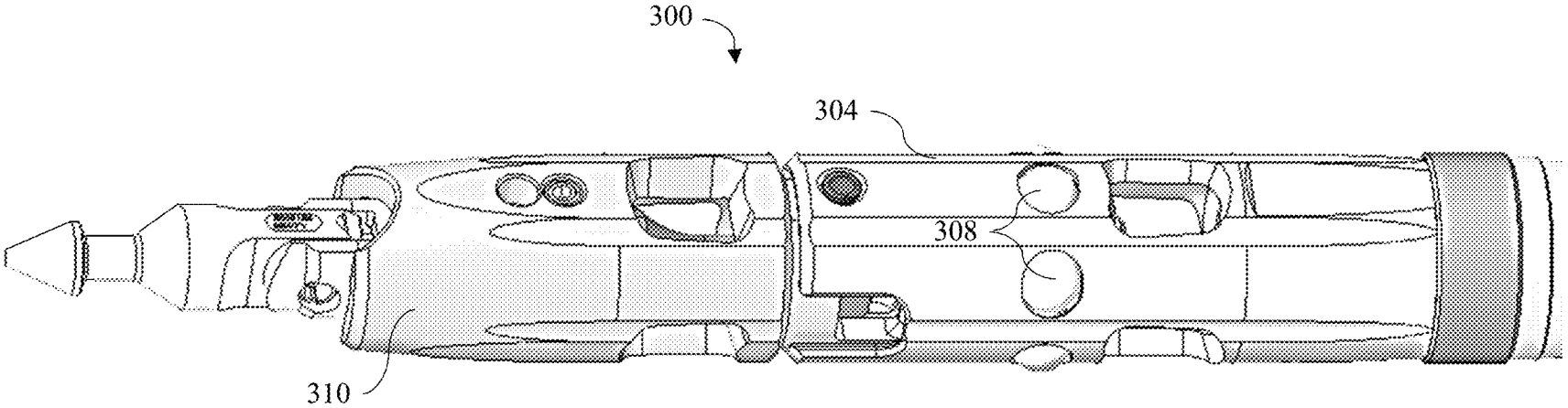
FIG. 15 is a side view of an upper portion of the head assembly as in FIG. 3, detailing a latch mechanism.
Figure 16:
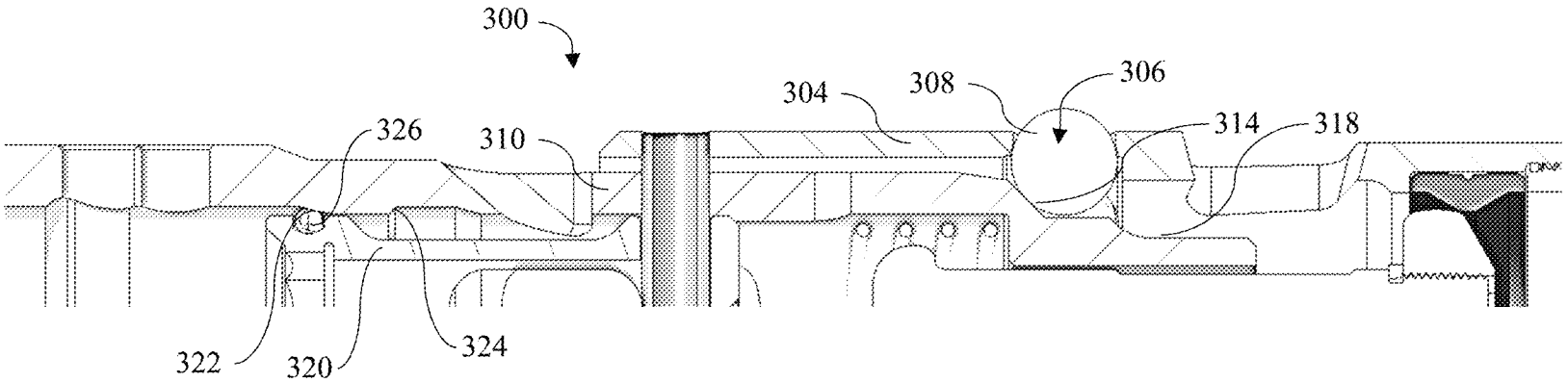
FIG. 16 is a cross-sectional view of the upper portion of the head assembly as in FIG. 15 with a proximal body in a first position.
Figure 17:
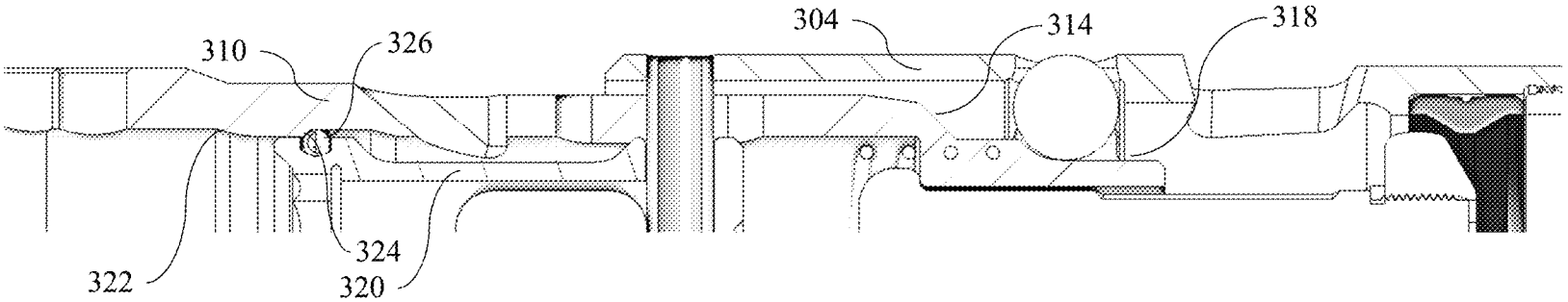
FIG. 17 is a cross-sectional view of the upper portion of the head assembly as in FIG. 15 with a proximal body in a second position.

Referring to FIGS. 15-17, the head assembly can comprise a latch mechanism 300 that is configured to engage the inner wall of the drill string to retain the head assembly 100 in position relative to the longitudinal axis of the drill string. The latch mechanism 300 can comprise latch body 304 that defines a plurality of through holes 306 that receive respective wedge members 308. The latch mechanism can further comprise a proximal body 310 that is receivable into the latch body and is axially movable relative to the latch body. The proximal body can comprise a circumferential surface 312 that defines one or more wedge surfaces 314 that are configured to drive the respective wedge members outwardly through the respective through-holes in the latch body when the proximal body is in a first axial position (FIG. 16) relative to the latch body. Optionally, the wedge members 308 can be balls, rollers, cams, or other suitable members that are configured to wedge against the inner walls of the drill string.

The proximal body can be configured to couple to a wireline (e.g., via a conventional spearhead coupling) to thereby receive a proximal force. The proximal force can move the proximal body 310 to a second axial position (FIG. 17) relative to the latch body 304. When the proximal body 310 is in the second axial position relative to the latch body that is proximal of the first axial position, the circumferential surface 312 of the proximal body can define a radially recessed portion 318 that allows the wedge members 308 to move radially inwardly to disengage from the inner surface of the drill string, thereby allowing the head assembly to move relative to the drill string.

A detent can retain the proximal body in its first and second positions. For example, an inner extension 320 can be fixedly coupled to the latch body (e.g., via a spring pin coupling) so that the inner extension cannot move axially relative to the latch body. The inner extension can define a groove that can receive a canted-coil spring 326. The proximal body can define a first shoulder 322 and a second shoulder 324 that are axially spaced from each other. The canted coil spring 326 can engage the first and second shoulders when the proximal body is in the first and second position, respectively, to serve as a detent to retain the proximal body in each position. That is, when the proximal body is in the first position, the canted coil spring can bias against the first shoulder when to inhibit movement of the proximal body toward the second position. When the proximal body is in the second position, the canted coil spring can bias against the second shoulder to inhibit movement of the proximal body toward the first position.

Exemplary Aspects

In view of the described devices, systems, and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1: A core barrel head assembly having a longitudinal axis, the core barrel head assembly comprising: an elongate tube body having an outer surface, an interior cavity, a proximal end, and a distal end, wherein the elongate tube body defines a helical groove that extends from the interior cavity to the outer surface of the elongate tube body, wherein the helical groove is configured to allow the elongate tube body to elastically extend from a neutral length to an elongated length.

Aspect 2: The core barrel head assembly of aspect 1, wherein the elongate tube body defines at least one aperture that extends between the interior cavity and the outer surface, wherein the helical groove is configured to allow the elongate tube body to elastically compress from the neutral length, wherein the core barrel head assembly further comprises a valve body that is attached to the elongate tube body and is movable with respect to the proximal end of the elongate tube body along the longitudinal axis, as the elongate tube body compresses, from a first position to a second position, wherein, when in the second position, the valve body causes a greater restriction to flow through the at least one aperture than when the valve body is in the first position.

Aspect 3: The core barrel head assembly of aspect 2, further comprising an electronics compartment having an outer surface, wherein the valve body defines an interior cavity, wherein the electronics compartment is disposed within the interior cavity of the valve body, wherein the electronics compartment is attached to the valve body so that the interior surface of the interior cavity of the valve body and the outer surface of the electronics department define a fluid passage, wherein the valve body, the electronics compartment, or a combination of at least one interior surface of the valve body and at least one exterior surface of the electronics compartment defines at least one opening for providing fluid communication between the fluid passage and the distal end of the valve body.

Aspect 4: A drilling system comprising: a drill string having: a drill bit at a distal end of the drill string; a core barrel head assembly of any of claims 1-3, wherein the core barrel head assembly has a distal end; and a core tube assembly attached to the core barrel head assembly, wherein the core tube assembly comprises: a core barrel having a distal end; and a core lifter case at the distal end of the core barrel; wherein, when the drill bit is in a drilling configuration, the drill bit is spaced distally of the core lifter case, and wherein, when the drill bit is in a core break configuration, the drill bit is in contact with the core lifter case, and the elongate tube is elongated from the neutral length.

Aspect 5: A method comprising: positioning the drill string of the system of aspect 4 within a borehole; receiving a core sample within the core barrel; and retracting the drill string until the drill bit is in the core break configuration.

Aspect 6: A core barrel head assembly having a longitudinal axis, the core barrel head assembly comprising: an elongate tube body having an outer surface, an interior cavity, a proximal end, and a distal end, wherein the elongate tube body defines at least one aperture that extends between the interior cavity and the outer surface; and a valve body that is movable with respect to the proximal end of the elongate tube along the longitudinal axis from a first position to a second position, wherein, when in the second position, the valve body causes a greater restriction to flow through the at least one aperture than when the valve body is in the first position.

Aspect 7: The core barrel head assembly of aspect 6, wherein the at least one aperture defines a total flow area of less than 0.5 square inches.

Aspect 8: The core barrel head assembly of aspect 7, wherein the at least one aperture has a width dimension along the longitudinal axis that is less than 0.25 inches.

Aspect 9: The core barrel head assembly of any of aspects 6-8 wherein the elongate tube body defines a helical groove that extends radially from the interior cavity to the outer surface of the elongate tube body and axially along the longitudinal axis of the core barrel head assembly, wherein the helical groove is configured to allow the elongate tube body to elastically compress from a neutral length.

Aspect 10: The core barrel head assembly of aspect 9, wherein the valve body is attached to the distal end of the elongate tube body.

Aspect 11: The core barrel head assembly of any of aspects 6-10, further comprising an electronics compartment having an outer surface, wherein the electronics compartment is disposed within the interior cavity of the valve body, wherein the electronics compartment is attached to the valve body so that the interior surface of the interior cavity of the valve body and the outer surface of the electronics department define a fluid passage, wherein the valve body, the electronics compartment, or a combination of at least one interior surface of the valve body and at least one exterior surface of the electronics compartment defines at least one opening for providing fluid communication between the fluid passage and the distal end of the valve body.

Aspect 12: A method comprising: positioning a drill string within a borehole, the drill string having a distal end, wherein the drill string comprises: at least one drill rod defining an interior bore, a drill bit at the distal end of the drill string, and a core barrel head assembly of any of claims 9-11, wherein the core barrel head assembly has a distal end and is disposed within the interior bore of the at least one drill rod, and a core barrel tube attached to the distal end of the core barrel head assembly; and receiving a core sample in the core barrel tube until the elongate tube body compresses to a length in which the valve body is in the second position.

Aspect 13: The method of aspect 12, further comprising retracting the drill string until the elongate tube body expands to a third length that is greater than the neutral length.

Aspect 14: A core barrel head assembly comprising: a valve body having a distal end and a proximal end, wherein the valve body defines an interior cavity having an interior surface; and an electronics compartment having an outer surface, wherein the electronics compartment is disposed within the interior cavity of the valve body, wherein the electronics compartment is attached to the valve body so that the interior surface of the interior cavity of the valve body and the outer surface of the electronics department define a fluid passage, and wherein the valve body, the electronics compartment, or a combination of at least one interior surface of the valve body and at least one exterior surface of the electronics compartment defines at least one opening for providing fluid communication between the fluid passage and the distal end of the valve body.

Aspect 15: The core barrel head assembly of aspect 14, wherein the electronics compartment houses at least one of a battery or an electronic orientation instrument.

Aspect 16: The core barrel head assembly of aspect 14 or aspect 15, wherein the fluid passage defined by the interior surface of the interior cavity of the valve body and the outer surface of the electronics department is an annular cavity.

Aspect 17: The core barrel head assembly of any of aspects 14-16, wherein the electronics compartment defines the at least one opening for providing fluid communication between the fluid passage and the distal end of the valve body.

Aspect 18: The core barrel head assembly of aspect 17, wherein a portion of the outer surface of the electronics compartment define at least one male thread along a threaded length, wherein the inner surface of the valve body defines at least one corresponding female thread, wherein the electronics compartment threadedly couples to the valve body via the at least one male thread and the at least one corresponding female thread, wherein the at least one opening extends through the electronics compartment along the threaded length.

Aspect 19: The core barrel head assembly of aspect 18, wherein the at least one opening comprises a plurality of openings separated by respective radially extending webs.

Aspect 20: The core barrel head assembly of any of aspects 14-16, wherein the valve body defines the at least one opening for providing fluid communication between the fluid passage and the distal end of the valve body.

Aspect 21: The core barrel head assembly of any of aspects 14-16, wherein the combination of at least one interior surface of the valve body and at least one exterior surface of the electronics compartment defines the at least one opening for providing fluid communication between the fluid passage and the distal end of the valve body.

Aspect 22: The core barrel head assembly of any of aspects 14-21, wherein the core barrel head assembly comprises a single thrust bearing.

Aspect 23: The core barrel head assembly of any of aspects 14-22, wherein the core barrel head assembly does not comprise a grease port.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A core barrel head assembly having a longitudinal axis, the core barrel head assembly comprising:

an elongate tube body having an outer surface, an interior cavity, a proximal end, and a distal end, wherein the elongate tube body defines a helical groove that extends from the interior cavity to the outer surface of the elongate tube body, wherein the helical groove is configured to allow the elongate tube body to elastically extend from a neutral length to an elongated length, wherein the outer surface of the elongate tube body defines an outer surface of the core barrel head assembly.

2. The core barrel head assembly of claim 1, wherein the elongate tube body defines at least one aperture that extends between the interior cavity and the outer surface, wherein the helical groove is configured to allow the elongate tube body to elastically compress from the neutral length, wherein the core barrel head assembly further comprises a valve body that is attached to the elongate tube body and is movable with respect to the proximal end of the elongate tube body along the longitudinal axis, as the elongate tube body compresses, from a first position to a second position, wherein, when in the second position, the valve body causes a greater restriction to flow through the at least one aperture than when the valve body is in the first position.

3. The core barrel head assembly of claim 2, wherein the at least one aperture defines a total flow area of less than 0.5 square inches.

4. The core barrel head assembly of claim 3, wherein the at least one aperture has a width dimension along the longitudinal axis that is less than 0.25 inches.

5. The core barrel head assembly of claim 2, further comprising an electronics compartment having an outer surface, wherein the valve body defines an interior cavity, wherein the electronics compartment is disposed within the interior cavity of the valve body, wherein the electronics compartment is attached to the valve body so that the interior surface of the interior cavity of the valve body and the outer surface of the electronics department define a fluid passage, wherein the valve body, the electronics compartment, or a combination of at least one interior surface of the valve body and at least one exterior surface of the electronics compartment defines at least one opening for providing fluid communication between the fluid passage and the distal end of the valve body.

6. The core barrel head assembly of claim 5, wherein the electronics compartment houses at least one of a battery or an electronic orientation instrument.

7. The core barrel head assembly of claim 5, wherein the fluid passage defined by the interior surface of the interior cavity of the valve body and the outer surface of the electronics department is an annular cavity.

8. The core barrel head assembly of claim 5, wherein the electronics compartment defines the at least one opening for providing fluid communication between the fluid passage and the distal end of the valve body.

9. The core barrel head assembly of claim 8, wherein the at least one opening comprises a plurality of openings separated by respective radially extending webs.

10. The core barrel head assembly of claim 5, wherein the valve body defines the at least one opening for providing fluid communication between the fluid passage and the distal end of the valve body.

11. The core barrel head assembly of claim 5, wherein the combination of at least one interior surface of the valve body and at least one exterior surface of the electronics compartment defines the at least one opening for providing fluid communication between the fluid passage and the distal end of the valve body.

12. The core barrel head assembly of claim 1, wherein the core barrel head assembly comprises a single thrust bearing.

13. The core barrel head assembly of claim 1, wherein the core barrel head assembly does not comprise a grease port.

14. A drilling system comprising:

a drill string having:

a drill bit at a distal end of the drill string;

a core barrel head assembly of claim 1, wherein the core barrel head assembly has a distal end; and a core tube assembly attached to the core barrel head assembly, wherein the core tube assembly comprises:

a core barrel having a distal end; and a core lifter case at the distal end of the core barrel;

wherein, when the drill bit is in a drilling configuration, the drill bit is spaced distally of the core lifter case, and wherein, when the drill bit is in a core break configuration, the drill bit is in contact with the core lifter case, and the elongate tube is elongated from the neutral length.

15. The core barrel head assembly of claim 1, wherein the helical groove is formed into the elongate tube body, wherein the elongate tube body has opposed longitudinal ends, wherein the helical groove has opposed ends that are between and spaced from the longitudinal ends of the elongate tube body.

16. A core barrel head assembly having a longitudinal axis, the core barrel head assembly comprising:

an elongate tube body having an outer surface, an interior cavity, a proximal end, and a distal end, wherein the elongate tube body defines at least one aperture that extends between the interior cavity and the outer surface; and a valve body that is movable with respect to the proximal end of the elongate tube along the longitudinal axis from a first position to a second position, wherein, when in the second position, the valve body causes a greater restriction to flow through the at least one aperture than when the valve body is in the first position.

17. The core barrel head assembly of claim 16, wherein the elongate tube body defines a helical groove that extends radially from the interior cavity to the outer surface of the elongate tube body and axially along the longitudinal axis of the core barrel head assembly, wherein the helical groove is configured to allow the elongate tube body to elastically compress from a neutral length.

18. The core barrel head assembly of claim 17, wherein the valve body is attached to the distal end of the elongate tube body.

19. The core barrel head assembly of claim 16, further comprising an electronics compartment having an outer surface, wherein the electronics compartment is disposed within the interior cavity of the valve body, wherein the electronics compartment is attached to the valve body so that the interior surface of the interior cavity of the valve body and the outer surface of the electronics department define a fluid passage, wherein the valve body, the electronics compartment, or a combination of at least one interior surface of the valve body and at least one exterior surface of the electronics compartment defines at least one opening for providing fluid communication between the fluid passage and the distal end of the valve body.

* * * * *